US010130149B1

(12) United States Patent
Liping

(10) Patent No.: US 10,130,149 B1
(45) Date of Patent: Nov. 20, 2018

(54) AIRTIGHT AND WATERPROOF SLIDE FASTENER WOVEN FROM NYLON

(71) Applicant: Xiong Liping, Shanghai (CN)

(72) Inventor: Xiong Liping, Shanghai (CN)

( * ) Notice: Subject to any disclaimer, the term of this patent is extended or adjusted under 35 U.S.C. 154(b) by 0 days.

(21) Appl. No.: 15/661,145

(22) Filed: Jul. 27, 2017

(51) Int. Cl.
*A44B 19/32* (2006.01)
*A44B 19/34* (2006.01)

(52) U.S. Cl.
CPC ..... *A44B 19/32* (2013.01); *A44B 19/346* (2013.01)

(58) Field of Classification Search
CPC ..... A44B 19/32; A44B 19/346
See application file for complete search history.

(56) References Cited

U.S. PATENT DOCUMENTS 8,091,186 B2 * 1/2012 Takazawa ..... A44B 19/32 24/389
8,112,848 B2 * 2/2012 Takazawa ..... A44B 19/26 24/389
9,474,341 B2 * 10/2016 Chou ..... A44B 19/24
2002/0017010 A1 * 2/2002 Neugebauer ..... A44B 19/32 24/391
2010/0005557 A1 * 1/2010 Cossutti ..... A44B 19/32 2/2.17
2010/0125982 A1 * 5/2010 Chou ..... A44B 19/32 24/397

* cited by examiner

*Primary Examiner* — Robert Sandy
*Assistant Examiner* — David M Upchurch
(74) *Attorney, Agent, or Firm* — Bay State IP, LLC

(57) ABSTRACT

The present invention provides a novel airtight and waterproof slide fastener woven from nylon, comprising a fastener tape and a fastener element. The nylon fastener element is woven on a tape made of high-strength polyester threads. A thermoplastic polyurethane eslatormer (TPU) layer is formed on the fastener tape on the back of the slide fastener. The TPU layer is permeated into gaps on the fastener tape and into gaps on the fastener element, and the TPU layer on the back of the fastener element has a thickness greater than that of the TPU layer at the location of the fastener tape to form a first TPU ridge. The first TPU ridge is cut from the middle. The surface of the first TPU ridge is heated and then squeezed to form a second TPU ridge.

5 Claims, 3 Drawing Sheets

AIRTIGHT AND WATERPROOF SLIDE FASTENER WOVEN FROM NYLON

TECHNICAL FIELD

The present invention relates to the technical field of slide fasteners and in particular to a novel airtight and waterproof slide fastener woven from nylon, which is convenient and durable and is highly waterproof and airtight.

BACKGROUND OF THE PRESENT INVENTION

The common airtight and waterproof slide fasteners have fastener tapes usually made of rubber material. Fastener elements having a small inner size and a large outer size are secured onto the rubber fastener tapes to realize the airtight and waterproof effect. Such slide fasteners are expensive. Moreover, the synthetic rubber contains many residual substances which are harmful to people's health and also cause pollution to the environment. Furthermore, such airtight slide fasteners are not anti-aging and not wear resistant and have a short service life. At present, there have been some airtight slide fasteners available in the market. Those airtight slide fasteners cannot be widely used since they are complex in structure, high in production cost and incapability of seamless connection to products, although they can provide the airtight and waterproof function.

Therefore, in view of the above defects and by long-term analysis and improvement, a convenient, durable, waterproof and airtight slide fastener is provided, which has the advantages of reduced cost, environmental protection, economic benefit, waterproofness, airtightness, UV resistance, corrosion resistance, anti-aging, wear resistance, etc., which can be widely used in the storage and maintenance of weapons and equipment in the military project and national defense fields, the storage and transportation in the aerospace industry, the protection of individual soldiers, the protection of chemical and medical professionals, and the protection of outdoor and aquatic sports men and their belongings.

SUMMARY OF THE PRESENT INVENTION

An objective of the present invention is to provide a novel highly-sealed, waterproof and airtight slide fastener woven from nylon to solve the technical problems in the prior art that the existing airtight slide fasteners are unsatisfactorily-sealed and are not waterproof and airtight.

For this purpose, the present invention employs the following technical solutions.

The present invention provides a novel airtight and waterproof slide fastener woven from nylon, comprising a fastener tape, a fastener element, an upper sealing tape, a lower sealing tape, a thermoplastic polyurethane eslatormer (TPU) layer, and a slider, wherein:

the fastener tape is of a split structure consisting of a left fastener tape and a right fastener tape, both the left fastener tape and the right fastener tape being woven from high-strength polyester threads;

the fastener element is of a split structure consisting of a left half fastener element and a right half fastener element, both the left half fastener element and the right half fastener element being made of nylon; and the left half fastener element is woven on an edge portion on a side of the left fastener tape and the right half fastener element is woven on an edge portion on a side of the right fastener tape, and the top contour of the left half fastener element and the right half fastener element is flush with the edge contour of the left fastener tape and the right fastener tape, respectively;

the slider is engaged with both the left half fastener element and the right half fastener element, and the slider can engage the left half fastener element with the right half fastener element to form a complete slide fastener or disengage the left half fastener element from the right half fastener element to break the seal;

the TPU layer is arranged on the other side of the fastener tape, and permeated into gaps, which are resulted from weaving, on the fastener tape and into the fastener element at a joint between the left fastener tape and the right fastener tape; and the TPU layer at the location of the fastener element has a thickness greater than that of the TPU layer at the location of the fastener tape to form a first TPU ridge;

the first TPU ridge is cut, by using a cutter and along the length direction thereof, from the middle thereof into a left half TPU ridge and a right half TPU ridge; upper portions of cut sidewalls of the left half TPU ridge and the right half TPU ridge are heated, respectively, to soften the surface to form softened layers, the softened layers are then squeezed so that the softened layers on the upper portions of the sidewalls of the left half TPU ridge and the right half TPU ridge respectively extend outward to form two second TPU ridges, and when the left half fastener element is engaged with the right half fastener element, the two second TPU ridges are tightly squeezed together to form a sealing structure at the joint of the fastener element; and the upper sealing tape and the lower sealing tape are arranged at two ends of the fastener element, respectively, both the upper sealing tape and the lower sealing tape being made of TPU material, the upper sealing tape sealing gaps, which are resulted from connection, between an upper end portion of the fastener element and the fastener tape while the lower sealing tape sealing gaps, which are resulted from connection, between a lower end portion of the fastener element and the fastener tape; and when the slider slides to the bottom of the fastener element to engage the left half fastener element with the right half fastener element, the lower sealing tape will enter a cavity of the slider to form a sealing structure.

As a further improvement of the present invention, the TPU layer is integrally formed by heating granular TPU material at high temperature into a liquid state and then extruding and coating, by using a mold and in a pressurized state, the liquid TPU material into the gaps, which are resulted from weaving, on the back of the fastener tape and into the gaps on the fastener element at the back joint of the fastener tape.

As a further improvement of the present invention, the upper sealing tape is manufactured by: injection molding the upper sealing tape of a square structure at the upper end of the fastener element and at the corresponding first TPU ridge on the back of the fastener element, the upper end of the fastener element being enclosed by the upper sealing tape; and injection molding the lower sealing tape of a semicircular structure at the lower end of the fastener element and at the corresponding first TPU ridge on the back of the fastener element, the lower sealing tape being capable of entering the cavity of the slider to be completely wrapped by the slider.

As a further improvement of the present invention, the lower sealing tape has a semicircular radian on its outer edge equal to that at a front end of the slider.

As a further improvement of the present invention, an edge portion of an inner side of the lower sealing tape extends vertically and upward to form a raised strip having a thickness greater than that of the cavity of the slider; and when the slider slides to the lower end of the fastener element, the lower sealing tape enters the cavity of the slider and the raised strip will be squeezed to form a sealing structure.

As a further improvement of the present invention, a core is provided in the cavity of the slider; and a space, by which the lower sealing tape is allowed to enter the cavity of the slider to be completely wrapped by the slider to form the airtight seal, is reserved between the core and the front end of the slider.

The present invention has the following beneficial effects.

1. In the present invention, during the formation of the TPU layer, the raw material is heated at high temperature into a liquid state, and then the liquid material is injected onto the surface of the fastener tape by continuous pressurization and then cooled. In this way, good permeation effect and good airtightness are exhibited.

2. In the present invention, the space between the adjacent teeth in the fastener element portion is completely filled by the TPU layer, without any gap between the teeth. This further improves the waterproofness and airtightness effect of the slide fastener.

3. In the present invention, when the slide fastener is closed, the two second TPU ridges around the fastener elements are tightly squeezed together to form an airtight sealing structure at the engagement of the fastener elements. By this airtight sealing structure, the two sides of the slide fastener are completely airtight. Such a slide fastener can be widely used in the storage and maintenance of weapons and equipment in the military project and national defense fields, the storage and transportation in the aerospace industry, the protection of individual soldiers, the protection of chemical and medical professionals, and the protection of outdoor and aquatic sports men and their belongings.

4. In the present invention, by the design of the upper and lower sealing tapes and the arrangement of a space between the core on the slider and the end face, the completely airtight connection between the slider and the end of the slide fastener can be ensured, and thus the sealing effect at the end of the slide fastener can be ensured. The slide fastener of the present invention also has the advantages of reduced cost, environmental protection, economic benefit, waterproofness, airtightness, UV resistance, corrosion resistance, anti-aging, wear resistance, etc.

BRIEF DESCRIPTION OF THE DRAWINGS

To describe the technical solutions in the embodiments of the present invention or in the prior art more clearly, drawings to be used in the description of the embodiments or the prior art will be briefly introduced below. Apparently, the drawings to be described below are merely some embodiments of the present invention. Other drawings may be obtained by a person of ordinary skill in the art according to those drawings without paying any creative effort.

FIG. 6 is a schematic diagram of the novel airtight and waterproof slide fastener woven from nylon according to the present utility model, when the second TPU ridges are formed, in which:

1: fastener tape;
11: left fastener tape;
12: right fastener tape;
2: fastener element;
21: left half fastener element;
22: right half fastener element;
3: TPU layer;
31: first TPU ridge;
311: left half TPU ridge;
312: right half TPU ridge;
32: second TPU ridge;
4: slider;
41: locking end;
42: pulling portion;
43: hook portion;
44: core;
45: interlocked position;
46: cavity;
5: upper sealing tape;
6: lower sealing tape;
61: chute;
62: raised strip;
7: TPU sealing strip;
8: sealing block;
9: heating device; and
10: squeezing device.

DETAILED DESCRIPTION OF THE PRESENT INVENTION

To make the objectives, technical solutions and advantages of the present invention more clear, the technical solutions of the present invention will be described below in detail. Apparently, the described embodiments are merely some but not all of the embodiments of the present invention. All other implementations obtained by a person of ordinary skill in the art on the basis of the embodiments of the present invention without paying any creative effort shall be included within the protection scope of the present invention.

Figure 1:
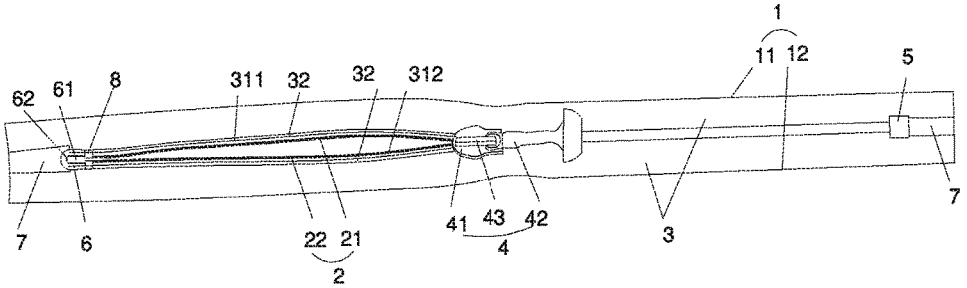
FIG. 1 is a structural diagram of a novel airtight and waterproof slide fastener woven from nylon according to the present invention.
Figure 2:
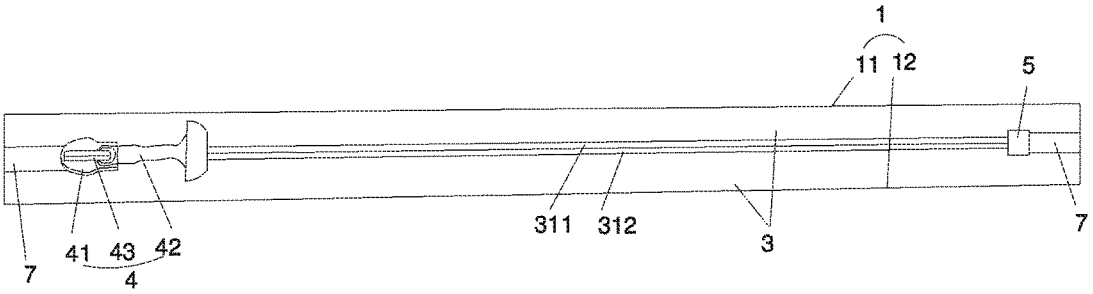
FIG. 2 is a structural diagram of the novel airtight and waterproof slide fastener woven from nylon according to the present utility model, when in the closed state.

As shown in FIG. 1 and FIG. 2, the present invention provides a novel airtight and watertight slide fastener woven from nylon, which is not prone to dropping during the future washing process, is durable, and also has the advantages of low cost, good waterproofness and airtightness, and environmental protection. In the present invention, gaps between the fastener element 2 and the fastener element 2 are filled so that better waterproofness and airtightness are realized. This slide fastener includes a fastener tape 1, a fastener element 2, an upper sealing tape 5, a lower sealing tape 6, a thermoplastic polyurethane eslatormer (TPU) layer 3, and a slider 4. The fastener tape 1 includes a left fastener tape 11 and a right fastener tape 12, which are separated from each other, and both the left fastener tape 11 and the right fastener tape 12 are woven from high-strength polyester threads. The fastener element 2 is of a split structure consisting of a left half fastener element 21 and a right half fastener element 22, both the left half fastener element 21 and the right half fastener element 22 being made of nylon; and the left half fastener element 21 is woven on an edge portion on a side of the left fastener tape 11 and the right half fastener element 22 is woven on an edge portion on a side of the right fastener tape 12, and the top contour of the left half fastener element 21 and the right half fastener element 22 is flush with the edge contour of the left fastener tape 11 and the right fastener tape 12, respectively. When the left half fastener element 21 is engaged with the right half fastener element 22, and when viewed from the back of the fastener tape 1, no fastener element 2 can be seen at the middle connection between the left fastener tape 11 and the right half fastener element 22. The slider 4 is engaged with both the left half fastener element 21 and the right half fastener element 22, and the slider 4 can engage the left half fastener element 21 with the right half fastener element 22 to form a complete slide fastener or disengage the left half fastener element 21 from the right half fastener element 22 to break the seal formed by the slide fastener.

To improve the airtightness and waterproofness of the slide fastener, in the present invention, the TPU layer 3 is arranged on the other side of the fastener tape 1, and permeated into gaps, which are resulted from weaving, on the fastener tape 1 and into the fastener element 2 at a joint between the left fastener tape 11 and the right tape 12; and the TPU layer 3 at the location of the fastener element 2 has a thickness greater than that of the TPU layer 3 at the location of the fastener tape 1 to form a first TPU ridge 31. When the TPU layer is to be prepared, the left half fastener element 21 is engaged with the right half fastener element 22; then, the edge portion of the left fastener tape 11 and the edge portion of the right fastener tape 12 are pulled by a device, respectively, so that a small gap is formed between the left fastener tape 11 and the right fastener tape 12, by this small gap, only the tops of the left half fastener element 21 and the right half fastener element 22 can be seen from the back of the fastener tape 1; and then, the TPU layer 3 is formed on the back of the fastener tape 1 so that the TPU layer 3 can be permeated into the gaps, which are resulted from weaving, on the fastener tape 1 and into the gaps on the fastener element 2 at the joint of the fastener tape 1.

Figure 6:
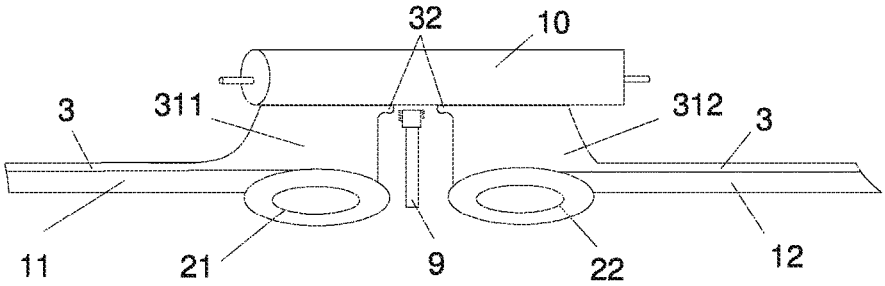

As shown in FIG. 6, to further improve the airtightness and waterproofness of the slide fastener, the first TPU ridge 31 is cut, by using a cutter and along the length direction thereof, from the middle thereof into a left half TPU ridge 311 and a right half TPU ridge 312; upper portions of cut sidewalls of the left half TPU ridge 311 and the right half TPU ridge 312 are heated by a heating device 9, respectively, to soften the surface to form softened layers, the softened layers are then squeezed by a squeezing device 10 so that the softened layers on the upper portions of the sidewalls of the left half TPU ridge 311 and the right half TPU ridge 312 respectively extend outward to form two second TPU ridges 32, and when the left half fastener element 21 is engaged with the right half fastener element 22, the two second TPU ridges 32 are tightly squeezed together to form a sealing structure at the joint of the fastener element 2; and at the joint between the upper and lower portions of the fastener element 2 and the fastener tape 1, to enhance the sealing effect, in the present invention, an upper sealing tape 5 and a lower sealing tape 6 are provided at two ends of the fastener element 2, respectively, both the upper sealing tape 5 and the lower sealing tape 6 being made of TPU material, the upper sealing tape 5 sealing gaps, which are resulted from connection, between an upper end portion of the fastener element 2 and the fastener tape 1 while the lower sealing tape 6 sealing gaps, which are resulted from connection, between a lower end portion of the fastener element 2 and the fastener tape 1; and when the slider 4 slides to the bottom of the fastener element 2 to engage the left half fastener element 21 with the right half fastener element 22, the lower sealing tape 6 will enter a cavity 46 of the slider 4 to form a sealing structure.

Figure 5:
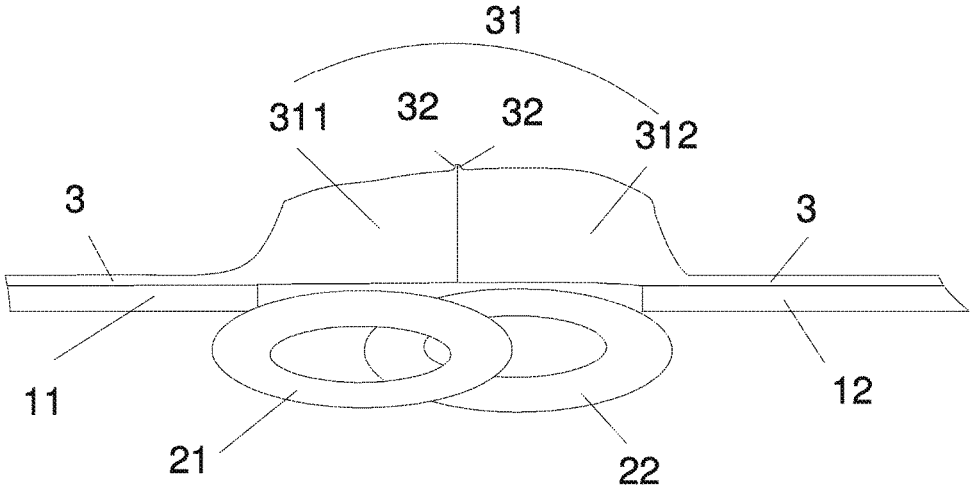
FIG. 5 is a cross-sectional view of the novel airtight and waterproof slide fastener woven from nylon according to the present utility model.

As shown in FIG. 5, the manufacturing process is specifically as follows: first, weaving the left half fastener element 21 onto the left fastener tape 11 and weaving the right half fastener element 22 onto the right fastener tape 12, and then engaging the left half fastener element 21 with the right half fastener element 22; heating the TPU material at high temperature into a liquid state, and then extruding and coating, by using a mold and in a pressurized state, the liquid TPU material into the gaps on the fastener element 2 and into the gaps on the fastener tape 1 to form a complete TPU layer 3 on a side of the slide fastener; and at high temperature and under high pressure, the TPU material is completely permeated into the gaps on the fastener tape 1 and into the gaps on the fastener element 2, and the TPU layer 3 forms a mixed layer having airtightness and waterproofness effect together with the fastener tape 1. When the TPU layer 3 is formed, the TPU layer 3 at the location of the fastener element 2 has a thickness greater than that of the TPU layer 3 at the location of the fastener tape 1 to form a first TPU ridge 31. Then, the complete TPU ridge 31 is cut, by using a cutter, along the middle connection line between the left half fastener element 21 and the right half fastener element 22, i.e., the middle of the first TPU ridge 31, into a left half TPU ridge 311 and a right half TPU ridge 312. The surfaces of the left half TPU ridge 311 and the right half TPU ridge 312 are heated by the heating device 9, respectively, to form softened layers, and the two softened layers are then squeezed by the squeezing device 10 so that the two softened layers respectively extend outward to form two second TPU ridges 32. Since the second TPU ridges 32 are formed by cutting the complete TPU layer 3 and then squeezing the outer edges of the cut ridges, the two second TPU ridges 32 will be tightly squeezed together to form the airtight seal when the slide fastener is closed.

The upper sealing tape 5 is manufactured by: injection molding the upper sealing tape 5 of a square structure at the upper end of the fastener element 2 and at the corresponding first TPU ridge 31 on the back of the fastener element 2, the upper end of the fastener element 2 being enclosed by the upper sealing tape 5; and injection molding the lower sealing tape 6 of a semicircular structure at the lower end of the fastener element 2 and at the corresponding first TPU ridge 31 on the back of the fastener element 2, the lower sealing tape 6 being capable of entering the cavity 46 of the slider 4 to be completely wrapped by the slider 4. The lower sealing tape 6 has a semicircular radian on its outer edge equal to that of a locking end 41 at a front end of the slider 4. An edge portion of an inner side of the lower sealing tape 6 extends vertically and upward to form a raised strip 62 having a thickness greater than that of the cavity 46 of the slider 4; and when the slider 4 slides to the lower end of the fastener element 2, the lower sealing tape 6 enters the cavity 46 of the slider 4 and the raised strip 62 will be squeezed to form a sealing structure.

As an optional implementation, the fastener tape 1 has a length greater than that of the fastener element 2; a space is reserved between the two ends to of the fastener element 2 and the two ends of the fastener tape 1, respectively a first space and a second space; a TPU sealing strip 7 is provided at each of the first space and the second space; the TPU sealing strip 7 seals the gaps between the left fastener tape 11 and the right fastener tape 12 each connected to the left half fastener element 21 and the right half fastener element 22 so as to realize the connection between the left fastener tape 11 and the right fastener tape 12, and the airtight seal is formed between the left fastener tape 11 and the right fastener tape 12; and the TPU sealing strip 7 is integrally injection molded with the first TPU layer 31 and the second TPU layer 32. A TPU sealing strip 7 is provided on each of two sides of the fastener tape 1.

Figure 3:
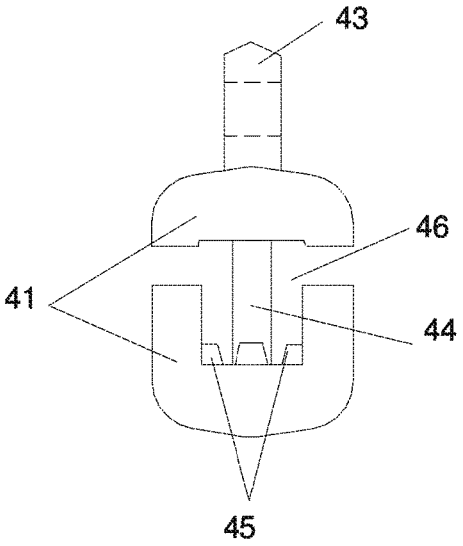
FIG. 3 is a front view of a slider in the novel airtight and waterproof slide fastener woven from nylon according to the present utility model.
Figure 4:
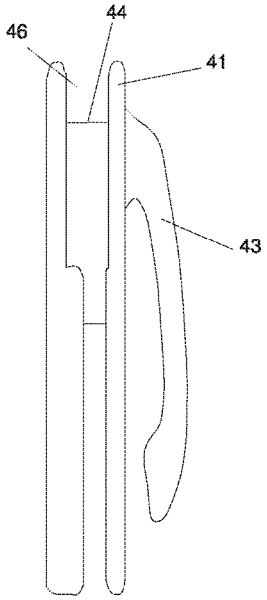
FIG. 4 is a side view of the slider in the novel airtight and waterproof slide fastener woven from nylon according to the present utility model.

As shown in FIG. 3 to FIG. 5, a chute 61, through which a core 44 on the slider 4 is passed, is formed on the lower sealing tape 6 at a position close to the fastener element 2. When the slide fastener is closed, a tail end of the locking end 41 of the slider 4 is flush with the lower sealing tape 6. A sealing block 8 is provided at each of the lower sealing tape 6 and the joint between the left half fastener element 21 and the right half fastener element 22, and the sealing block 8 has a thickness which is equal to the height of the cavity 46 of the slider 4. A hook portion 43 is provided on the top of the slider 4. A pulling portion 42 is detachably provided on the hook portion 43, and the slider 4 is controlled to go forward or backward by holding the pulling portion 42. The locking end 41 is arranged in the front portion of the slider 4. The core 44 is arranged within the locking end 41. A space is reserved between the core 44 and the end portion of the locking end 41, and the space is less than the distance from the chute 61 on the lower sealing tape 6 to the edge of the lower sealing tape 6. By this space, the lower sealing tape 6 is allowed to enter the cavity 46 of the slider 4 to be completely wrapped by the slider 4 to form the airtight seal.

When in practical use, when the slide fastener is closed, the pulling portion 42 is pulled; and by the slider 4, the left half fastener element 21 and the right half fastener element 22 within the cavity 46 are pulled to an interlocked position 45. In the cavity 46, the left half fastener element 21 and the right half fastener element 22 are separated by the core 44, and the interlocked position 45 is in the rear portion of the core 44. The left half fastener element 21 and the right half fastener element 22 enter the interlocked position 45 to be engaged together after passing through the core 44, and in this way, the slide fastener is closed. When the slider 4 slides to the position of the lower sealing tape 6, since the sealing block 8 has a thickness equal to the height of the cavity 46, the cavity 46 is filled by the sealing block 8, and in this way, the aright seal is formed between the slider 4 and the closed end. When the slider 4 is at the lowest closed end, the locking end 41 of the slider 4 is flush with the outer edge of the lower sealing tape 6.

The foregoing descriptions are merely specific implementations of the present invention and the protection scope of the present invention is not limited thereto. Any changes or replacements made by those skilled in the art within the technical scope disclosed in the present invention shall fall into the protection scope of the present invention. Therefore, the protection scope of the present invention shall be subject to the protection scope defined by the appended claims.

The invention claimed is:

1. A novel airtight and waterproof slide fastener woven from nylon, comprising a fastener tape (1), a fastener element (2), an upper sealing tape (5), a lower sealing tape (6), a thermoplastic polyurethane eslatormer (TPU) layer (3), and a slider (4), wherein:

the fastener tape (1) is of a split structure consisting of a left fastener tape (11) and a right fastener tape (12), both the left fastener tape (11) and the right fastener tape (12) being woven from polyester threads;

the fastener element (2) is of a split structure consisting of a left half fastener element (21) and a right half fastener element (22), both the left half fastener element (21) and the right half fastener element (22) being made of nylon; and the left half fastener element (21) is woven on an edge portion on a side of the left fastener tape (11) and the right half fastener element (22) is woven on an edge portion on a side of the right fastener tape (12), and the top contour of the left half fastener element (21) and the right half fastener element (22) is flush with the edge contour of the left fastener tape (11) and the right fastener tape (12), respectively;

the slider (4) is engaged with both the left half fastener element (21) and the right half fastener element (22), and the slider (4) can engage the left half fastener element (21) with the right half fastener element (22) to form a complete slide fastener or disengage the left half fastener element (21) from the right half fastener element (22) to break the seal;

the TPU layer (3) is arranged on an other side of the fastener tape (1), and permeated into gaps, which are resulted from weaving, on the fastener tape (1) and into the fastener element (2) at a joint between the left fastener tape (11) and the right fastener tape (12); and the TPU layer (3) at the location of the fastener element (2) has a thickness greater than that of the TPU layer (3) at the location of the fastener tape (1) to form a first TPU ridge (31);

the first TPU ridge (31) is cut, by using a cutter and along the length direction thereof, from the middle thereof into a left half TPU ridge (311) and a right half TPU ridge (312); upper portions of cut sidewalls of the left half TPU ridge (311) and the right half TPU ridge (312) are heated, respectively, to soften the surface to form softened layers, the softened layers are then squeezed so that the softened layers on the upper portions of the sidewalls of the left half TPU ridge (311) and the right half TPU ridge (312) respectively extend outward to form two second TPU ridges (32), and when the left half fastener element (21) is engaged with the right half fastener element (22), the two second TPU ridges (32) are tightly squeezed together to form a sealing structure at the joint of the fastener element (2); and the upper sealing tape (5) and the lower sealing tape (6) are arranged at two ends of the fastener element (2), respectively, both the upper sealing tape (5) and the lower sealing tape (6) being made of TPU material, the upper sealing tape (5) sealing gaps, which are resulted from connection, between an upper end portion of the fastener element (2) and the fastener tape (1) while the lower sealing tape (6) sealing gaps, which are resulted from connection, between a lower end portion of the fastener element (2) and the fastener tape (1); and when the slider (4) slides to the bottom of the fastener element (2) to engage the left half fastener element (21) with the right half fastener element (22), the lower sealing tape (6) will enter a cavity (46) of the slider (4) to form a sealing structure;

wherein the upper sealing tape (5) is manufactured by injection molding the upper sealing tape (5) of a square structure at an upper end of the fastener element (2) and at the corresponding first TPU ridge (31) on the back of the fastener element (2), the upper end of the fastener element (2) being enclosed by the upper sealing tape (5) and injection molding the lower sealing tape (6) of a semicircular structure at a lower end of the fastener element (2) and at the corresponding first TPU ridge (31) on the back of the fastener element (2), the lower sealing tape (6) being capable of entering the cavity (46) of the slider (4) to be completely wrapped by the slider (4).

2. The novel airtight and waterproof slide fastener woven from nylon according to claim 1, wherein the TPU layer (3) is integrally formed by heating granular TPU material at high temperature into a liquid state and then extruding and coating, by using a mold and in a pressurized state, the liquid TPU material into the gaps, which are resulted from weaving, on the back of the fastener tape (1) and into the gaps on the fastener element (2) at a back joint of the fastener tape (1).

3. The novel airtight and waterproof slide fastener woven from nylon according to claim 1, wherein the lower sealing tape (6) has a semicircular radian on its outer edge equal to that at a front end of the slider (4).

4. The novel airtight and waterproof slide fastener woven from nylon according to claim 1, wherein an edge portion of an inner side of the lower sealing tape (6) extends vertically and upward to form a raised strip (62) having a thickness greater than that of the cavity (46) of the slider (4); and when the slider (4) slides to the lower end of the fastener element (2), the lower sealing tape (6) enters the cavity (46) of the slider (4) and the raised strip (62) will be squeezed to form a sealing structure.

5. The novel airtight and waterproof slide fastener woven from nylon according to claim 1, wherein a core (44) is provided in the cavity (46) of the slider (4); and a space, by which the lower sealing tape (6) is allowed to enter the cavity (46) of the slider (4) to be completely wrapped by the slider (4) to form the airtight seal, is reserved between the core (44) and the front end of the slider (4).

* * * * *